US006041751A

United States Patent [19]

Kuriyama et al.

[11] Patent Number: 6,041,751

[45] Date of Patent: Mar. 28, 2000

[54] OIL PAN OF INTERNAL COMBUSTION ENGINE

[75] Inventors: Satomitsu Kuriyama; Tsukasa Yamazaki, both of Yokohama; Kazuhiko Matsuzaka, Kanagawa, all of Japan

[73] Assignee: Nissan Motor Co., Ltd., Yokohama, Japan

[21] Appl. No.: 09/077,964

[22] PCT Filed: Jan. 7, 1998

[86] PCT No.: PCT/JP98/00016

§ 371 Date: Jun. 15, 1998

§ 102(e) Date: Jun. 15, 1998

[87] PCT Pub. No.: WO98/30789

PCT Pub. Date: Jul. 16, 1998

[30] Foreign Application Priority Data

Jan. 13, 1997 [JP] Japan ..... 9-003714

[51] Int. Cl.[7] ..... F02F 7/00; F01M 1/04

[52] U.S. Cl. ..... 123/195 C; 123/198 E; 184/6.5; 184/106

[58] Field of Search ..... 123/195 C, 198 E, 123/196 R; 184/6.5, 106

[56] References Cited

FOREIGN PATENT DOCUMENTS

| | | |
|---|---|---|
| 2 673 245 | 8/1992 | France . |
| 61-91047 | 6/1986 | Japan . |
| 62-110553 | 7/1987 | Japan . |
| 6-336952 | 12/1994 | Japan . |
| 7-83112 | 3/1995 | Japan . |
| 7-166834 | 6/1995 | Japan . |

*Primary Examiner*—Willis R. Wolfe
*Assistant Examiner*—Brian Hairston
*Attorney, Agent, or Firm*—Foley & Lardner

[57] ABSTRACT

An oil pan to be installed to a cylinder block of an internal combustion engine mounted on an automotive vehicle. The oil pan comprises an oil pan main body section which includes a deep pan section for storing lubricating oil, and a shallow pan section integral with the deep pan section. A baffle plate is fixedly disposed inside the oil pan main body and extends to cover a lower part of an inside of the deep pan section. The baffle plate is located generally horizontal in a condition where the vehicle on which the engine is mounted is located on a generally horizontal road. The baffle plate is located spaced from a surface of the lubricating oil stored inside the deep pan section. The baffle plate includes a generally horizontally extending main body section, and an oil maintaining wall which projects upward from an upper surface of the main body section so as to retain the lubricating oil on the main body section.

16 Claims, 7 Drawing Sheets

OIL PAN OF INTERNAL COMBUSTION ENGINE

The contents of Japanese Patent Application No. 9-3714, with a filing date of Jan. 13, 1997 in Japan, are hereby incorporated by reference.

TECHNICAL FIELD

This invention relates to improvements in structure of an oil pan of an internal combustion engine to prevent vibration of the oil pan, and more particularly to a technique for suppressing vibration of a deep pan section of the oil pan which vibration serves as a major source of noise generated from the oil pan.

BACKGROUND ART

Most internal combustion engines such as automotive internal combustion engines are provided with an oil pan which is located beneath a cylinder block and formed relatively deep. The oil pan stores therein lubricating oil which is sucked by an oil pump and fed under pressure to a variety of engine parts. Such an oil pan is generally formed of a metal such as aluminum alloy or the like and fabricated to have a thin wall structure, and therefore tends to make its diaphragm vibration under input of vibration of the engine thereby to generate or radiate relatively high level noise.

In view of the above, a variety of structures of oil pan have been hitherto proposed to suppress generation of noise from the oil pan, as disclosed in Japanese Patent Provisional Publication No. 7-166834, Japanese Patent Provisional Publication No. 6-336952, Japanese Patent Provisional Publication No. 7-83112, Japanese Utility Model Provisional Publication No. 61-91047, and Japanese Utility Model Publication No. 62-110553. For example, in the noise generation suppression structure disclosed in Japanese Patent Provisional Publication No. 7-166834, an inner pan is provided having bottom and side walls similar in shape to the inner surfaces of the bottom and side walls of the shallow pan section of an oil pan, and disposed in such as a manner as to lie over the shallow pan section without being fixed to the oil pan. The inner pan is provided with an oil maintaining wall to maintain therein lubricating oil, thereby suppressing generation of noise from the shallow pan section of the oil pan.

However, the above conventional noise generation suppression structure as disclosed in Japanese Patent Provisional Publication No. 7-166834 and similar structures as disclosed in other conventional structures disclosed in the other Publications cannot be expected to offer an effect to suppress vibration of the deep pan section of the oil pan which vibration serves as a major source of noise generated from the whole oil pan. Additionally, the conventional technique having the inner pan invites an increase in weight and therefore is problematic from the viewpoint of weight-lightening of the oil pan and the engine.

Additionally, the conventional technique disclosed in Japanese Patent Provisional Publication No. 7-83112 uses a baffle plate which is fixedly disposed at the upper opening of an oil pan in order to suppress movement (such as waving) of the surface of lubricating oil inside the oil pan for the purpose of stabilizing the lubricating oil surface. However, even this technique never offers an effect to suppress noise generation from the deep pan section of the oil pan.

SUMMARY OF THE INVENTION

It is an object of the present invention to provide an improved oil pan of an internal combustion engine, which can effectively overcome drawbacks encountered in conventional oil pans of internal combustion engines.

Another object of the present invention is to provide an improved oil pan of an internal combustion engine, which can effectively suppress noise generation from the oil pan while achieving the weight-lightening of the oil pan.

A further object of the present invention is to provide an improved oil pan of an internal combustion engine, in which noise generation from the deep pan section of the oil pan can be effectively suppressed under the action of a baffle plate which covers the inside of the deep pan section and retains thereon lubricating oil.

An aspect of the present invention resides in an oil pan to be installed to a cylinder block of an internal combustion engine. The oil pan comprises an oil pan main body section which includes a deep pan section for storing lubricating oil, and a shallow pan section integral with the deep pan section. A baffle plate is fixedly disposed inside the oil pan main body and extends to cover a lower part of an inside of the deep pan section. The baffle plate is located generally horizontal in a condition where a vehicle on which the engine is mounted is located on a generally horizontal road. The baffle plate is located spaced from a surface of the lubricating oil stored inside the deep pan section. The baffle plate includes a generally horizontally extending main body section, and an oil maintaining wall which projects upward from an upper surface of the main body section so as to retain the lubricating oil on the main body section.

Another aspect of the present invention resides in an oil pan to be installed to a cylinder block of an internal combustion engine. The oil pan comprises an oil pan main body section including a deep pan section for storing lubricating oil, and a shallow pan section integral with the deep pan section. A baffle plate is fixedly disposed inside the oil pan main body so as to cover a lower part of an inside of the deep pan section. The baffle plate is shaped to retain thereon lubricating oil. The baffle plate is located between a surface of lubricating oil stored inside the deep pan section of the oil pan main body and an upper end of the oil pan main body so as to form a layer of air between the baffle plate and the surface of the lubricating oil stored inside the deep pan section.

By virtue of the baffle plate retaining thereon the lubricating oil, vibration of the deep pan section of the oil pan can be effectively suppressed thereby lowering the level of noise generated and radiated from the oil pan deep pan section. The vibration of the deep pan section serves as a major source of noise generated and radiated from the oil pan. Additionally, the baffle plate is small in surface area and weight relative to the conventional inner pan and therefore largely contributes to weight-lightening of the oil pan and accordingly the engine.

BRIEF DESCRIPTION OF DRAWINGS

In the drawings, like reference numerals designate like parts and elements therethrough, in which.

DETAILED DESCRIPTION OF THE INVENTION

Figure 1:
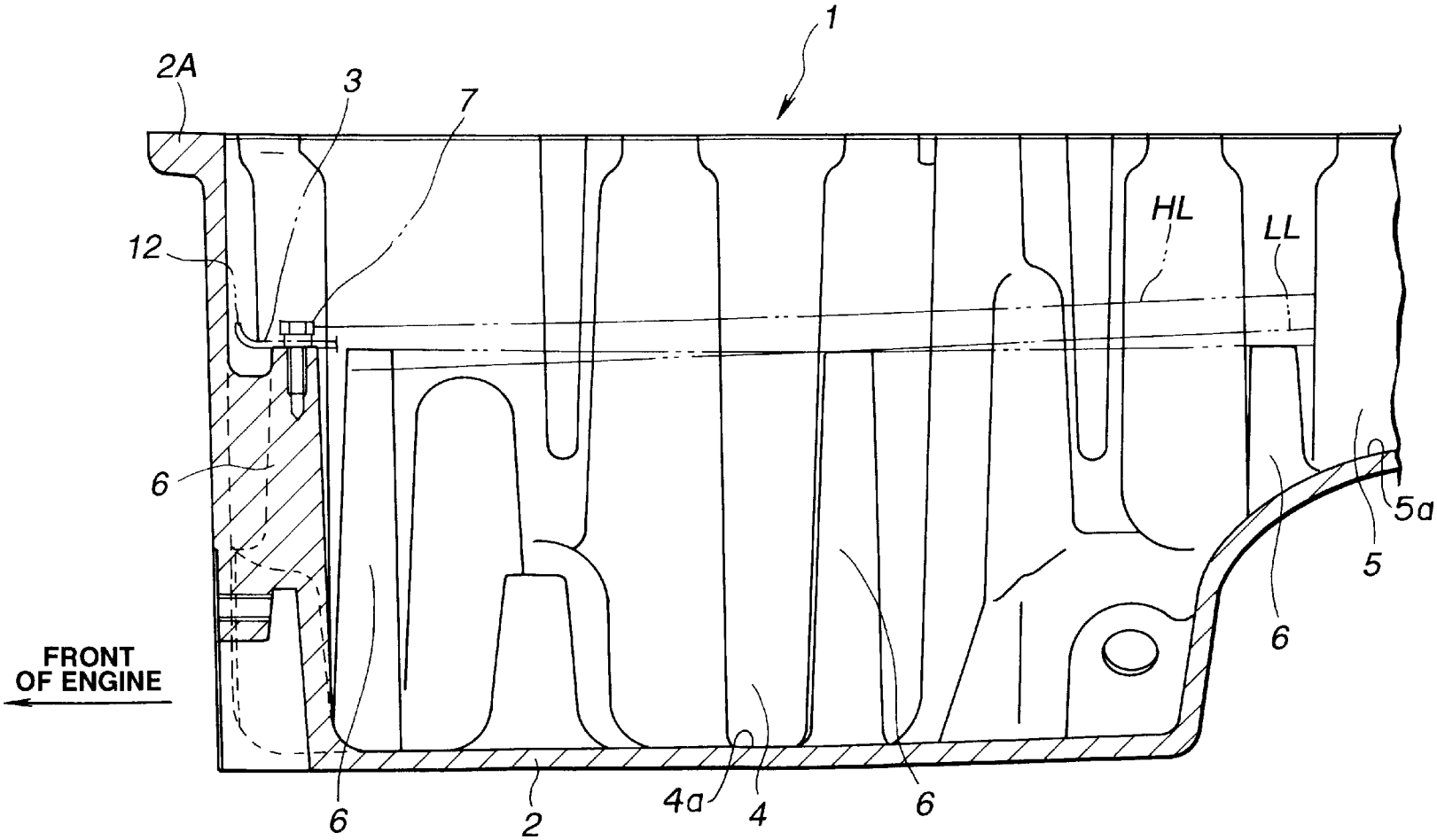
FIG. 1 is a fragmentary vertical sectional view of an embodiment of an oil pan of an internal combustion engine, according to the present invention.
Figure 2:
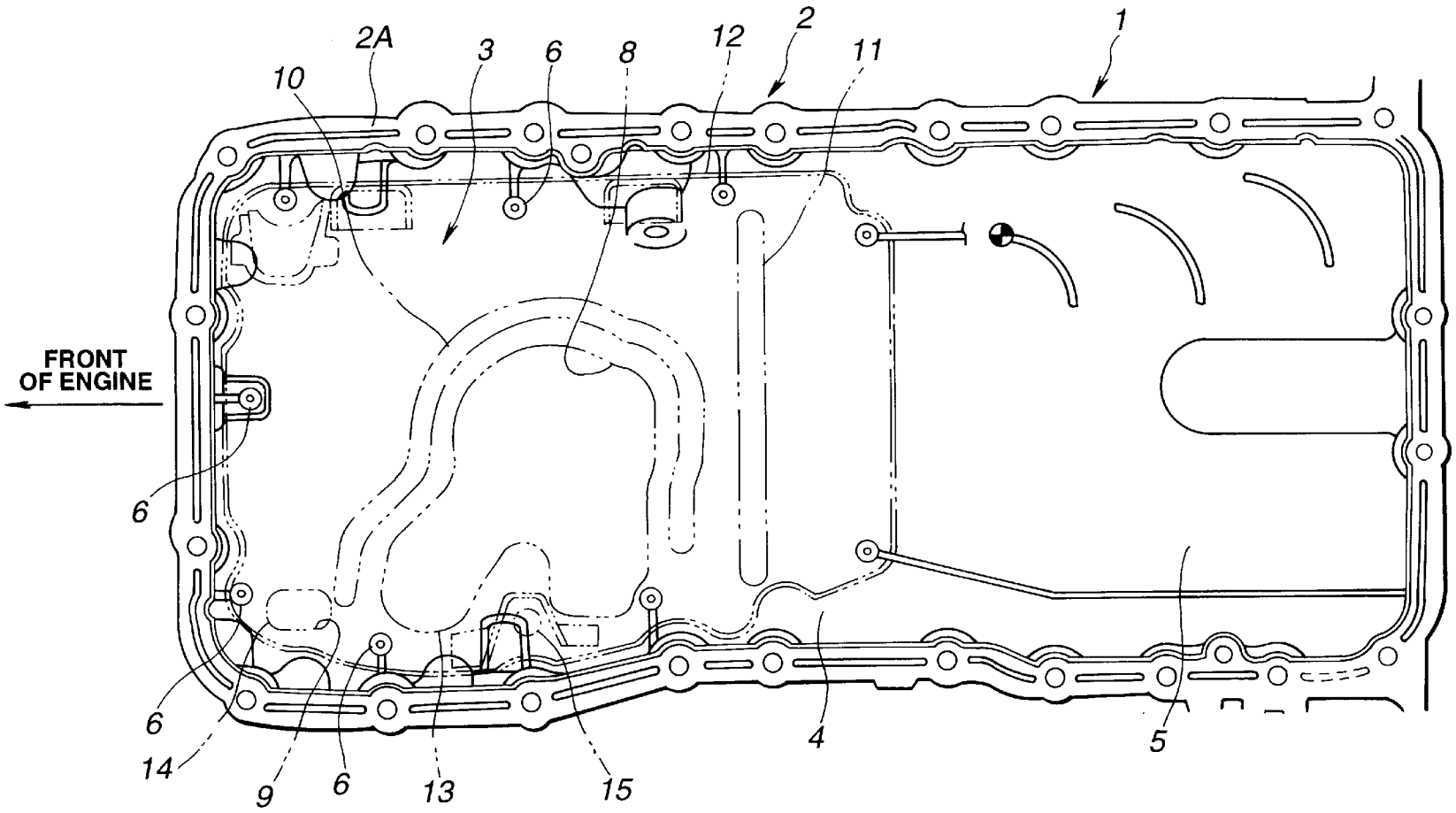
FIG. 2 is a plan view of the oil pan of FIG. 1.
Figure 3A:
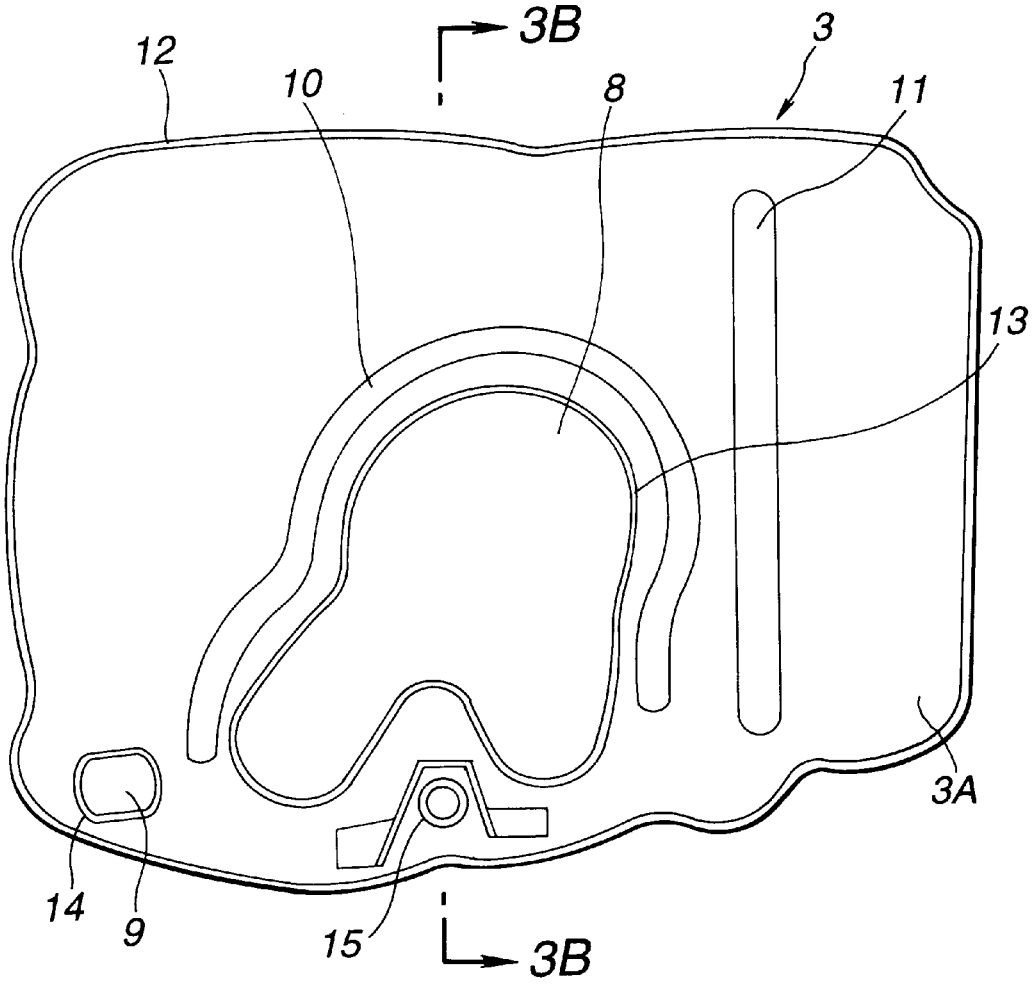
FIG. 3A is a plan view of a baffle plate forming part of the oil pan of FIG. 1.
Figure 3B:
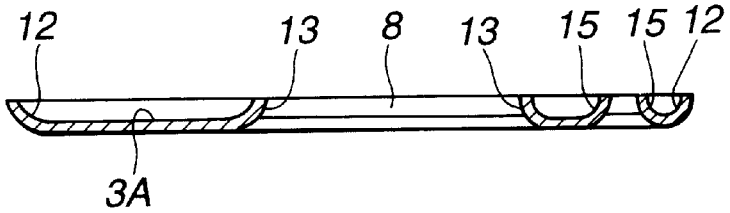
FIG. 3B is a cross-sectional view taken in the direction of arrows substantially along the line 3B—3B of FIG. 3A.
Figure 4:
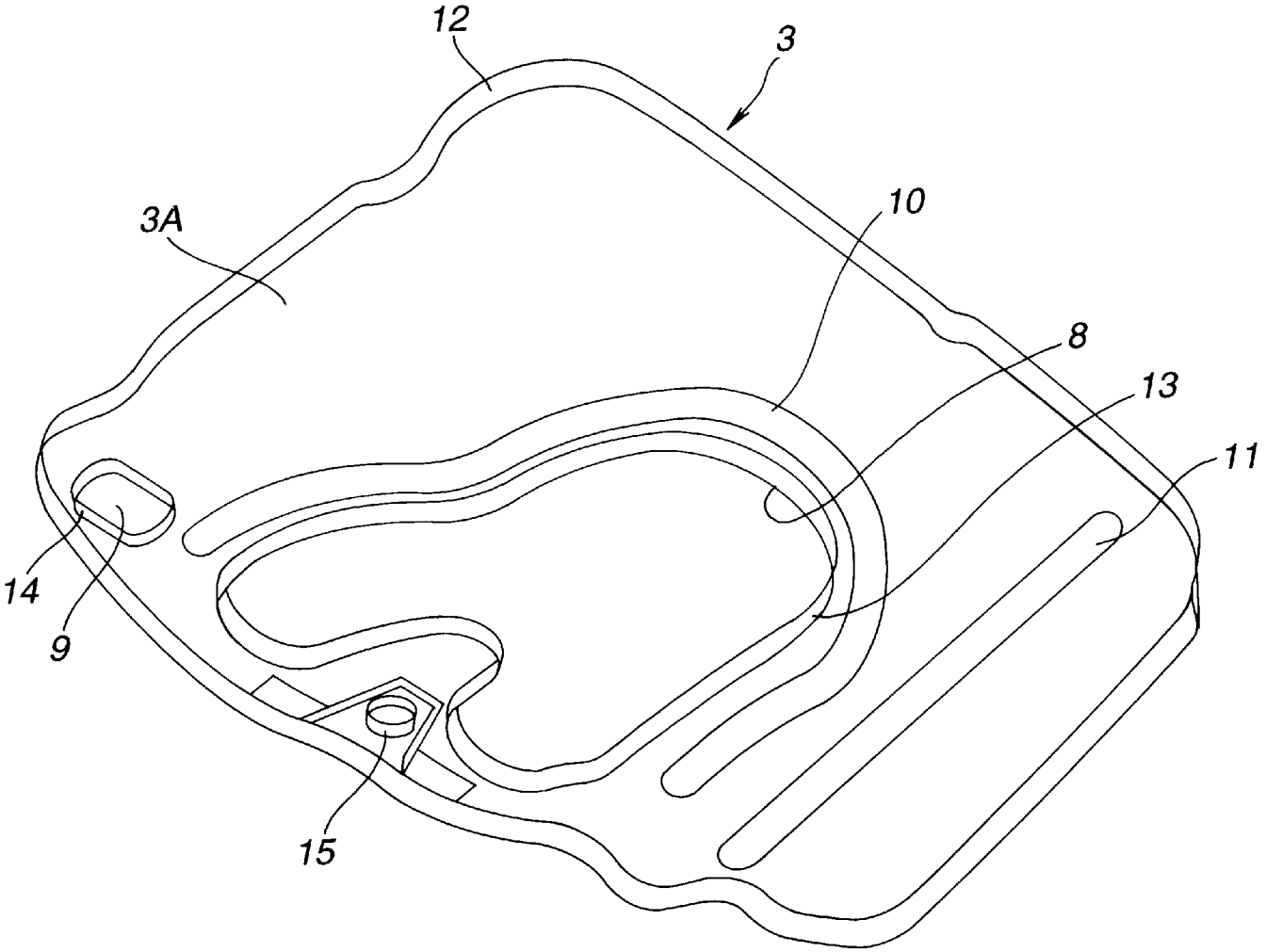
FIG. 4 is a perspective view of the baffle plate of FIG. 3A.

Referring now to FIGS. 1 to 4 of the drawings, an embodiment of an oil pan of an internal combustion engine, according to the present invention is illustrated by the reference numeral 1. The oil pan 1 is fixed to the bottom surface of a cylinder block (not shown) of the internal combustion engine. The oil pan 1 comprises an oil pan main body 2 which is a molded body fabricated of aluminum alloy. The oil pan main body 2 is generally rectangular in plan as shown in FIG. 2 and extends along the longitudinal axis or fore-and-aft direction of the engine. The oil pan main body 2 includes a deep pan section 4 located forward of a shallow pan section 5 in the fore-and-aft direction of the engine. The bottom wall 4*a* of the deep pan section 4 projects downward relative to the bottom wall 5*a* of the shallow pan section 5. Each of the deep and shallow pan sections 4, 5 is generally rectangular in plan. The deep pan section 4 is integral with the shallow pan section 5 to form a continuous depression extending in the fore-and-aft direction of the vehicle. The deep pan section 4 is formed thereinside an oil sump for storing lubricating oil. The oil pan 1 is provided with a flange section 2A which is formed along the upper end periphery of the oil pan main body 2 and bolted to the bottom end periphery of the cylinder head.

A baffle plate 3 is disposed inside the oil pan main body 2 and located to generally cover the oil sump of the deep pan section 4. The baffle plate 3 is located to extend generally horizontal in a state to be installed to the cylinder block of the engine which is mounted on an automotive vehicle located on a horizontal ground. Specifically, the baffle plate 3 is located generally parallel with the upper end periphery of the oil pan main body 2 and therefore with the upper surface of the flange section 2A of the oil pan main body 2. The baffle plate 3 is generally parallel with the bottom wall 4*a* of the deep pan section 4 of the oil pan main body 2 and located spaced from the upper end periphery of the oil pan main body 2 and the flat bottom wall 4*a* of the deep pan section 4.

The baffle plate 3 is fabricated, for example, by pressing a metal sheet or plate generally into the tray-shape. The baffle plate 3 is fixed at its peripheral section, with bolts 7, to the tip end of a plurality of installation bosses 6 which are integral with the oil pan main body 2 and projected upwardly from the inner wall surface of the oil pan main body 2. The baffle plate 3 includes a flat bottom wall or main body section 3A which is formed with an oil strainer inserting hole 8, an oil level gauge inserting hole 9, and the like hole. An oil strainer (not shown) is inserted through the hole 8 into the oil sump inside the deep pan section 4 of the oil pan main body 2 during an assembly operation of the engine. An oil level gauge (not shown) is inserted through the oil level gauge inserting hole 9 into the oil sump.

The baffle plate 3 has a plurality of oil maintaining walls 12, 13, 14, 15 which are formed projecting generally upward to have a predetermined height from the upper surface of the flat wall section 3A, so that the baffle plate 3 is generally tray-shaped so as to be filled with lubricating oil. The oil maintaining wall 12 is generally annular and formed along the periphery of the flat wall section 3A. The oil maintaining wall 13 is generally annular and formed along the periphery defining the oil strainer inserting hole 8. The oil maintaining wall 14 is generally annular and formed along the periphery defining the oil level gauge inserting hole 9. The oil maintaining wall 15 is generally annular and formed along the periphery of a hole. Clearances are formed between the outer peripheral surface of the baffle plate 3 and the inner surface of the oil pan main body 2. The baffle plate 3 is formed at its flat wall section 3A with ribs 10, 11 for the reinforcement purpose, in which the ribs 10, 11 are formed projecting upwardly or downwardly relative to the upper or lower surface of the flat wall section 3A. The baffle plate 3 is located to be separate from the surface or level of lubricating oil stored in the deep pan section 4 of the oil pan main body 2 so as to form a space between the baffle plate 3 and the oil level. Under the action of the oil maintaining walls 12, 13, 14, 15, the oil level in the baffle plate 3 is at a high level HL when the engine is generally horizontal while that is at a low level LL when the engine is inclined, as shown in FIG. 1.

Next, function of the thus arranged oil pan will be discussed.

Lubricating oil stored in the oil sump formed inside the deep pan section 4 of the oil pan main body 2 is sucked by an oil pump (not shown) and fed under pressure to a variety of parts of the engine. Accordingly, during engine operation, the oil level in the oil pan main body 2 is lowered below that during stopping of engine operation. Particularly, there is the possibility of the oil level being lowered below the inner surface of the bottom wall of the shallow pan section 5 in a high engine speed operating range of the engine.

The lubricating oil used in the variety of the engine parts is discharged through an oil return hole (not shown) and the like formed at the upper section of a crankcase (not shown) and flows down along the inner surface of the crankcase to drop onto the baffle plate 3. Since the baffle plate 3 is provided with the oil maintaining walls 12, 13, 14, 15 so as to be generally tray-shaped, the lubricating oil is maintained on the flat wall section 3A of the baffle plate 3 and stored to have an oil level corresponding to the height of the oil maintaining walls from the upper surface of the flat wall section 3A. The lubricating oil overflown out of the baffle plate 3 drops into the oil sump formed in the deep pan section 4.

Here, it is to be noted that, during engine operation, the oil level or surface of the lubricating oil in the deep pan section 4 of the oil pan main body 2 is lowered, and therefore vibration of the deep pan section 4 is made. However, the oil pan of this embodiment has thereinside a three-layer structure including a lubricating oil layer stored in the deep pan section 4, an air layer lying between the baffle plate 3 and the surface of the lubricating oil, and a lubricating oil layer retained on the baffle plate 3. This three-layer structure functions to suppress vibration of the deep pan section 4 which vibration is a major source of noise radiated from the oil pan 1.

In order to prove the fact that the above embodiment exhibits a sufficient vibration suppression effect, experiments were conducted under the following conditions:

(a) The height of the oil maintaining walls 12, 13, 14, 15 was set within a range of from 3 to 20 mm, preferably 5 to 10 mm. It is to be noted that the upper limit of the height of the oil maintaining walls is set to avoid the following difficulties: If the tray-shaped baffle plate 3 is so deep as to retain a large amount of lubricating oil, engine moving parts to be projectable inside the oil pan 1 will strike against the lubricating oil thereby generating noise.

(b) The volume of the lubricating oil maintained on the baffle plate 3 is set within a range of from 4 to 26%, preferably 5 to 10%, of the volume of the lubricating oil stored in the deep pan section 4.

(c) The baffle plate 3 is located horizontal (when the vehicle is located on the horizontal ground) and positioned slightly higher than a vertical center of the deep pan section 4. More specifically, the height (vertical distance) of the baffle plate 3 from the bottom wall 4*a* of the deep pan section 4 is about ⅔ of the height (vertical distance) of the oil pan 1. Additionally, the baffle plate 3 is located above the level of lubrication oil by a distance ranging from 10 to 30 mm.

Figure 5:
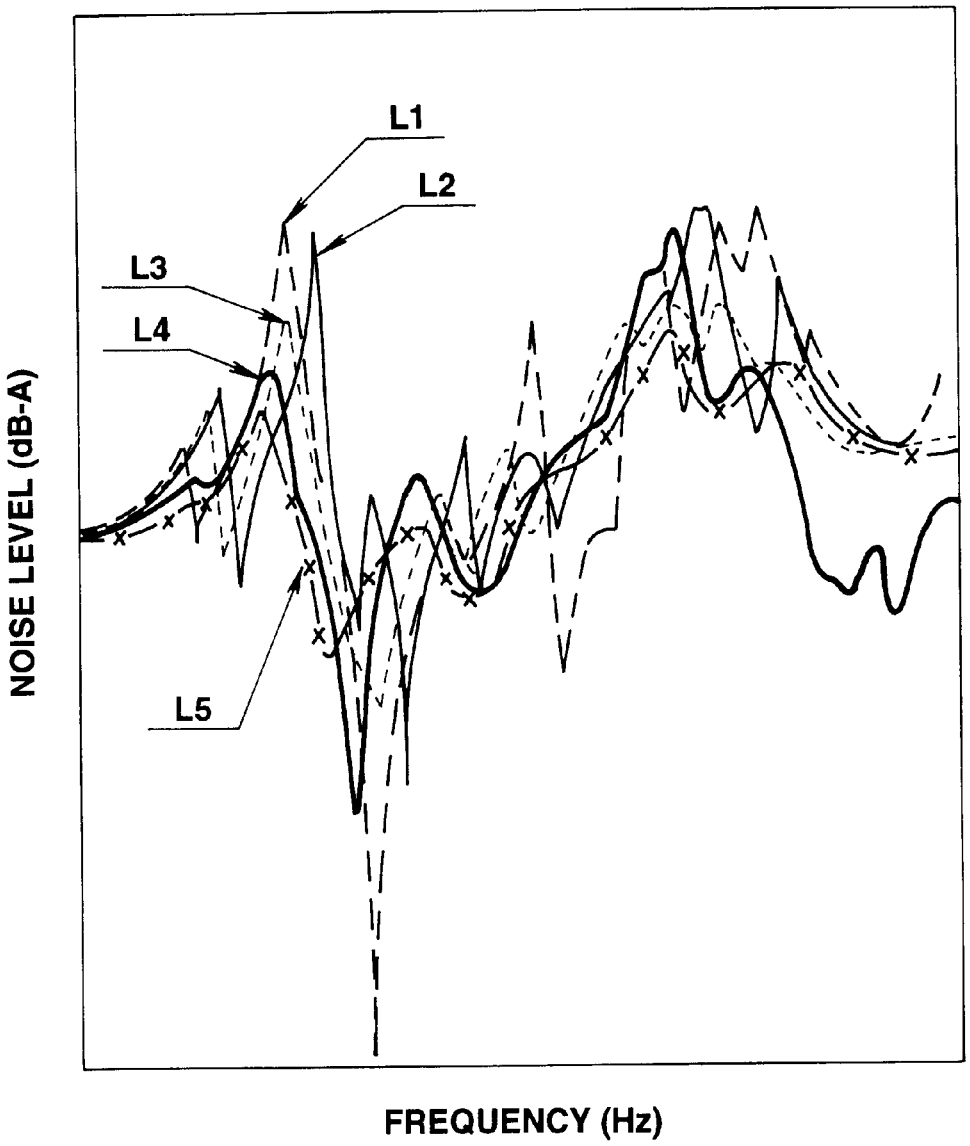
FIG. 5 is a graph showing experimental data of variation of noise level in terms of height of oil maintaining walls of the baffle plate of FIG. 3A.
Figure 6:
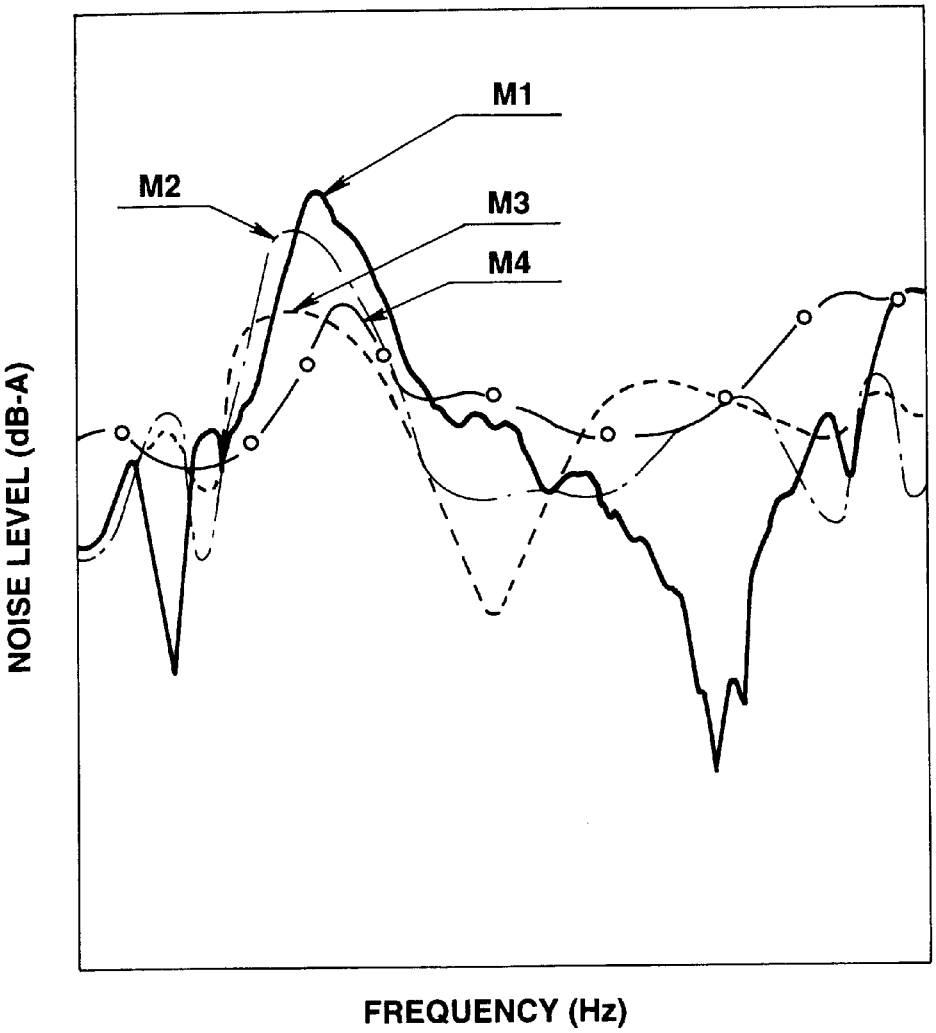
FIG. 6 is a graph showing experimental data of variation of noise level in terms of volume percentage of lubricating oil retained on the baffle plate relative to lubricating oil stored in the deep pan section of the oil pan.

Here, the results of the above experiments by the inventors are shown in FIGS. 5 and 6. In the experiments, the oil pan having the following arrangement was used: The amount of lubricating oil stored in the deep pan section 4 was 2.7±0.5 (liter); The surface area of the baffle plate was about 33% (about ⅓) of the surface area of the oil pan (the surface area was obtained by vertically projecting the baffle plate or the oil pan onto a horizontal plane which is parallel with the upper surface of the flange section 2A of the oil pan main body 2); The clearance between the peripheral surface of the baffle plate 3 and the inner peripheral surface of the oil pan main body 2 was within a range of from 5 to 10 mm.

FIG. 5 depicts variations of noise levels of the engine in case that the baffle plate 3 had the oil maintaining walls 12, 13, 14, 15 each of which had a height of 0 mm (the baffle plate had no oil maintaining wall), 3 mm, 5 mm, 10 mm and 20 mm. Curves L1, L2, L3, L4, L5 correspond to the baffle plates which have respectively oil maintaining walls of the heights of 0 mm, 3 mm, 5 mm, 10 mm and 20 mm. The result in FIG. 5 demonstrates the fact that the baffle plate 3 having oil maintaining walls of the height of 3 mm, 5 mm, 10 mm or 20 mm largely contributes to suppression of vibration of the deep pan section 4 as compared with the baffle plate having no oil maintaining wall. Such baffle plates are recognized to achieve a low noise level of the engine and to be high in noise reduction effect.

FIG. 6 depicts variations of noise levels of the engine in case that the volume of the lubricating oil retained on the baffle plate 3 was 3% (the baffle plate had no oil maintaining wall), 6%, 10% and 30% relative to that of the lubricating oil stored in the deep pan section 4. Curves M1, M2, M3, M4 correspond respectively to the baffle plates which respectively has the volumes of 3%, 6%, 10% and 30%. The result in FIG. 6 demonstrates that the baffle plates retaining the lubricating oil in the volumes of 6%, 10% and 30% relative to the volume of the lubricating oil stored in the deep pan section largely contribute to suppression of noise generation from the deep pan section 4 of the oil pan main body 2. Such baffle plates are recognized to achieve a low noise level of the engine and to be high in noise reduction effect.

It will be understood that the oil pan of this embodiment is configured to merely add the oil maintaining wall(s) to the baffle plate, and therefore the weight of the oil pan is small hereby contributing to weight-lightening of the engine.

Figure 7:
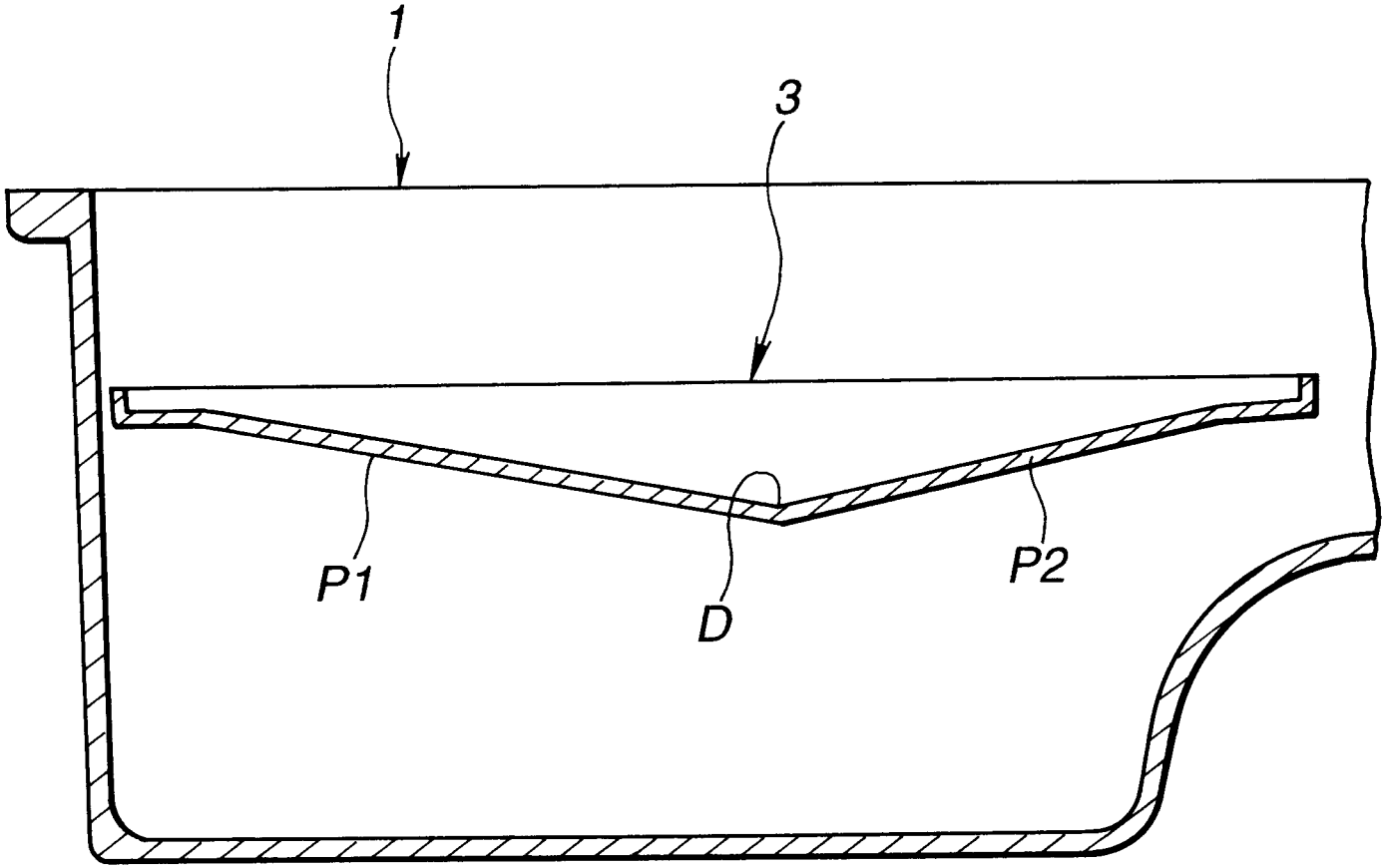
FIG. 7 is a schematic fragmentary vertical sectional view of another embodiment of the oil pan of an internal combustion engine, according to the present invention.

FIG. 7 illustrates another embodiment of the oil pan according to the present invention, similar to the oil pan of the embodiment of FIGS. 1 to 4. In this embodiment, the flat bottom wall section 3A of the baffle plate 3 is inclined in the fore-and-aft direction of the engine in such a manner that the deepest position D is located around the center of the baffle plate 3 in the fore-and-aft direction. More specifically, the flat bottom wall section 3A includes first and second flat parts P1, P2 which are generally rectangular. The first flat part P1 inclines downward in the direction toward the rear of the engine and reaches the deepest position D, while the second flat part P2 extends from the deepest position D and inclines upward in the direction toward the rear of the engine. The angle of incline of the first and second parts P1, P2 relative to a horizontal plane is preferably not larger than 15 degrees which correspond to slope having a 20% incline at which an automotive vehicle is generally runnable.

With this baffle plate 3, even during running of the vehicle on a sloped road or during parking of the vehicle on a steep sloped ground, lubricating oil can be securely retained on the baffle plate 3. This making it possible to lower the noise and vibration levels of the vehicle which is running on the sloped road or at engine starting after parking and being left on the steep sloped road.

INDUSTRIAL APPLICABILITY

The present invention is applicable to effectively suppress vibration of an oil pan of internal combustion engines such as an automotive internal combustion engines thereby lowering a noise level of vehicles such as automotive vehicles.

We claim:

1. An oil pan for a cylinder block of an internal combustion engine, comprising:

an oil pan main body having a deep pan section for storing lubricating oil and a shallow pan section integral with said deep pan section; and a baffle plate fixedly disposed inside said oil pan main body and extending in a generally horizontal direction to substantially cover a lower part of an inside of said deep pan section, wherein a level of the lubricating oil in said deep pan section is lowered under a predetermined operative condition of the engine, said baffle plate including a generally horizontally extending baffle plate main body section and an oil maintaining wall surrounding an entire periphery of said baffle plate main body section and projecting upward from an upper surface of said baffle plate main body section so as to retain the lubricating oil on said baffle plate main body section.

2. An oil pan as claimed in claim 1, further comprising a second oil maintaining wall extending along a periphery defining a first hole formed in said baffle plate main body section, each of said oil maintaining walls having a predetermined height from said upper surface of said baffle plate main body section.

3. An oil pan as claimed in claim 2, further comprising a third generally annular oil maintaining wall which extends along a periphery defining a second hole formed in said baffle plate main body section, said third oil maintaining wall having a predetermined height from said upper surface of said baffle plate main body section, wherein said first hole is for inserting an oil strainer, and said second hole is for inserting an oil level gauge.

4. An oil pan as claimed in claim 1, wherein said oil maintaining wall has a predetermined height from said upper surface of said baffle plate main body section, said predetermined height being within a range of from 3 to 20 mm.

5. An oil pan as claimed in claim 4, wherein said predetermined height is within a range of from 5 to 10 mm.

6. An oil pan as claimed in claim 1, wherein a volume of lubricating oil retained on said baffle plate main body section is within a range of from 4 to 26% of a volume of lubricating oil stored inside said deep pan section of said oil pan main body.

7. An oil pan as claimed in claim 6, wherein the volume of lubricating oil retained on said baffle plate main body section is within a range of from 5 to 10% of the volume of lubricating oil stored inside said deep pan section of said oil pan main body.

8. An oil pan as claimed in claim 1, wherein said baffle plate is located at a position which is higher than a vertical center of a height of said oil pan main body, said position being separate from an upper end of said oil pan main body.

9. An oil pan as claimed in claim 8, wherein a height of said baffle plate from a bottom wall of said deep pan section of said oil pan main body is about ⅔ of a height of said oil pan main body.

10. An oil pan as claimed in claim 8, wherein said baffle plate is located spaced by a predetermined distance from the surface of the lubricating oil stored in said deep pan section of said oil pan main body, said predetermined distance being within a range of from 10 to 30 mm.

11. An oil pan as claimed in claim 1, wherein said baffle pate main body section includes first and second parts which are integral with each other at a central position which is located around a center of said baffle plate main body section in a fore-and-aft direction of the engine, each of said first and second parts inclining downward at a predetermined angle in a direction toward the central position.

12. An oil pan as claimed in claim 11, wherein said predetermined angle is within a range of not larger than 15 degrees.

13. An oil pan as claimed in claim 1, wherein said baffle plate extends in such a manner as to uncover a major part of an inner surface of said shallow pan section.

14. An oil pan for a cylinder block of an internal combustion engine, comprising:

an oil pan main body having a deep pan section for storing lubricating oil and a shallow pan section integral with said deep pan section; and a baffle plate fixedly disposed inside said oil pan main body so as to cover a lower part of an inside of said deep pan section, said baffle plate being shaped to retain thereon lubricating oil, said baffle plate being located between a surface of lubricating oil stored inside said deep pan section of said oil pan main body and an upper end of said oil pan main body so as to form a layer of air between said baffle plate and the surface of the lubricating oil stored inside said deep pan section, said baffle plate including an oil maintaining wall surrounding an entire periphery of said baffle plate and projecting upward from an upper surface of said baffle plate so as to retain the lubricating oil on said baffle plate.

15. An oil pan as claimed in claim 1, wherein said baffle plate main body section is formed with a plurality of holes, and wherein said baffle plate further has a plurality of oil maintaining walls which respectively surround entire peripheries of said holes and project upward from said upper surface of said baffle plate main body section so as to retain the lubricating oil on said baffle plate main body section.

16. An oil pan as claimed in claim 1, wherein said deep pan section of said oil pan main body is formed with a hole through which the lubricating oil is discharged.

* * * * *